United States Patent [19]

Hasker et al.

[11] 4,143,447

[45] Mar. 13, 1979

[54] METHOD OF MAKING A LOW-PRESSURE GAS DISCHARGE LAMP

[75] Inventors: Jan Hasker; Petrus R. van Ijzendoorn; Hendrik Roelofs, all of Eindhoven, Netherlands

[73] Assignee: U.S. Philips Corporation, New York, N.Y.

[21] Appl. No.: 877,162

[22] Filed: Feb. 13, 1978

[30] Foreign Application Priority Data

Feb. 23, 1977 [NL] Netherlands ..... 7701910

[51] Int. Cl.[2] ..... H01J 9/00

[52] U.S. Cl. ..... 29/25.13; 313/203

[58] Field of Search ..... 313/203; 29/25.11, 25.13; 140/71.5

[56] References Cited

U.S. PATENT DOCUMENTS

| | | | |
|---|---|---|---|
| 1,472,505 | 10/1923 | Trimble | 140/71.5 |
| 2,000,163 | 5/1935 | Clark | 140/71.5 |
| 2,133,205 | 10/1938 | McCauley | 313/203 |
| 2,170,066 | 8/1939 | Ruben | 313/203 |
| 2,824,251 | 2/1958 | Patterson | 140/71.5 |

*Primary Examiner*—Richard B. Lazarus
*Assistant Examiner*—John McQuade
*Attorney, Agent, or Firm*—Robert S. Smith

[57] ABSTRACT

A method for manufacturing a low pressure gas discharge lamp having a body present in the discharge vessel which consists of a longitudinal support which extends into the longitudinal direction of the vessel. The support being provided with fibres which are distributed over the space within the discharge vessel and extend substantially transversely from the support.

8 Claims, 2 Drawing Figures

METHOD OF MAKING A LOW-PRESSURE GAS DISCHARGE LAMP

Figure 1:
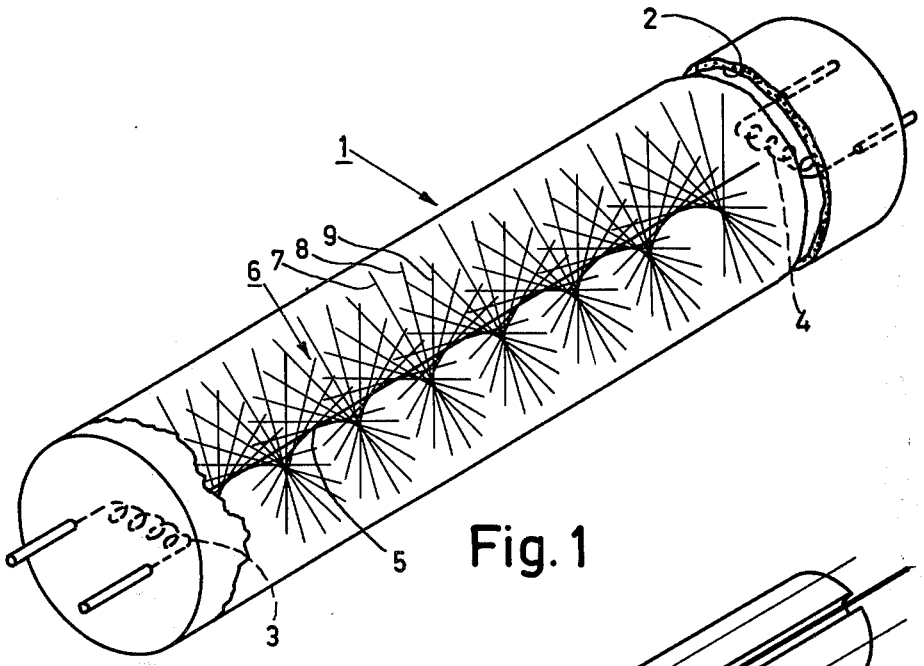

Disclosed is a low-pressure discharge lamp with a discharge vessel in which a body having a thinly-distributed structure which is permeable to the discharge is disposed between the electrodes. Furthermore, the invention relates to a method for producing such lamps.

From Dutch Patent Application No. 7409366 which has been laid open to public inspection it is known to provide the discharge vessel of low pressure gas discharge lamps. such as low pressure mercury vapour discharge lamps and low pressure sodium vapour discharge lamps with a body of solid matter having a structure which is transmissive to the discharge, such as thinly distributed glass wool, quartz glass or gehlenite glass wool in order to increase the luminous flux per unit of lamp volume.

The effect of the presence of said body in the discharge space is that at the same current strength through the lamp the lamp voltage can considerably be increased, the detrimental effects which occur with lamps without such a body if the lamp power is increased by stepping up the lamp current, occurring to a considerably lesser degree.

One of the requirements with lamps, low pressure mercury discharge lamps in particular, provided with such a body having a thin structure, must satisfy is that the distribution of the elements from which the body is composed is sufficiently uniform because otherwise, owing to non-homogeneities in the discharge unwanted light intensity and temperature differences over the tube wall are produced. In low pressure mercury discharge lamps the temperature differences result in mercury deposit on the colder parts and in low pressure sodium lamps in the formation of sodium mirrors on the colder spots.

It is an object of the invention to provide a lamp which satisfies the above-mentioned requirement. At the same time it is an object of the invention to provide a thin body which can be produced outside the discharge vessel and which is sufficiently rigid so that it can be disposed in a simple manner in the discharge vessel without unwanted changes in the form being produced.

A low pressure discharge lamp of the type mentioned above is characterized in accordance with the invention in that the body consists of a longitudinal support, extending in the longitudinal direction of the discharge vessel, provided with fibres which are distributed over the space within the discharge vessel and extending into the transverse direction of the support.

The thin body used in accordance with the invention is sufficiently rigid so that hardly any form changes are produced during fabrication of the lamp. Consequently the required uniform structure is retained. In addition the body can be fixed in a simple manner in the discharge vessel by fitting, for example, one end of the support to the wall of the discharge vessel by means of an adhesive, such as glass enamel. Also during the so-called "exhausting" of the lamp, after the body has been disposed in the discharge vessel, the arrangement of the fibres, owing to the rigidity of the body, is hardly disturbed.

In an embodiment of a lamp according to the invention, especially with lamps having a cylindrical discharge vessel, the support is disposed at or near the longitudinal axis of the discharge vessel. In such a lamp a stable and uniform build-up of the discharge is obtained and the intensity and temperature distribution over the wall is very uniform.

In a further embodiment of a lamp according to the invention the fibres extend to as far as the wall of the discharge vessel. As a consequence, without further auxiliary means the entire structure is properly positioned in the discharge vessel which also results in a stable and uniform build-up of the discharge.

The fibres are preferably secured to the support by means of an adhesive. An example of an adhesive which is disposed in the form of a coating on the support is Capton (Trade Mark). After the adhesion between fibres and support has been effected the coating is, if necessary, baked to remove the binder necessary for applying the coating and for hardening the coating itself. The coating may also serve as electrical insulator.

The support preferably consists of a metal wire which is provided with an electrically insulating coating to prevent short-circuiting of the discharge. Glass enamel may, for example, be chosen as the insulating coating. This has the advantage that the coating may also serve asthe connection between the fibres and the supporting wire. This connection can, for example, be made by heating the supporting wire, for example by means of an electric current. This causes the glass enamel to soften and, hence, to hole the fibres. On cooling of the wire a rigid connection is made between the fibres and the support wire.

The radiant flux of a lamp according to the invention is particularly high if the thinly distributed body has a low absorption for the useful radiation produced by the discharge, which may be located both in the visible and in the ultra-violet part of the spectrum. The fibres are chosen such that the useful radiation is properly transmitted. The fibres preferably consists of quartz or glass. If the fibres have too strong an absorption for the useful radiation a surface coating at which reflection is produced can be applied. This surface coating is, for example, magnesium oxide or titanium oxide.

The body having a structure and a form according to the invention is produced before it is brought into the discharge vessel. The body may be formed by connecting a wire-shaped support to a plurality of fibres which are situated substantially perpendicularly to the support whereafter the support is twisted about its axis so that the fibres extend into spacially distributed directions.

Preferably in a method according to the invention a metal wire which is coated with a layer of glass enamel is disposed in a longitudinal groove of a cylindrical jig whereafter glass or quartz fibre wire is wound on the jig whereby the supporting wire is heated and the glass enamel softens so that fusion of the supporting wire with the fibre wire is effected, whereafter the fibre wire is cut over the surface of the jig at at least one side of the supporting wire so that a plurality of fibres is formed. The supporting wire provided with fibres is thereafter twisted about its axis outside the groove while being heated. Thereafter the entire structure thus obtained is pushed into the discharge vessel and the further lamp operations are performed.

The pitch of the glass fibre wire wound around the winding jig determines the ultimate density of the structure built-up on the metal supporting wire.

The production of the above-mentioned bodies can be accelerated by using a winding jig having a large diameter in which several longitudinal grooves with supporting wires are disposed and/or by winding several fibre wires simultaneously.

The invention can be used for many diverse kinds of low pressure gas discharge lamps; typical examples being low pressure sodium discharge lamps and low pressure mercury discharge lamps, either provided or not provided with a luminescent coating. The discharge vessel need not of necessity be cylindrical. The discharge vessel may be U-shaped, a respective body being provided in either leg of the "U". It is also not necessary for the support to be arranged at or near the longitudinal axis of the discharge vessel. With certain types of compact fluorescent lamps it may be advantageous to dispose the support excentrically in the discharge vessel.

An embodiment of the invention will now be further explained with reference to a drawing.

In a drawing

Figure 2:
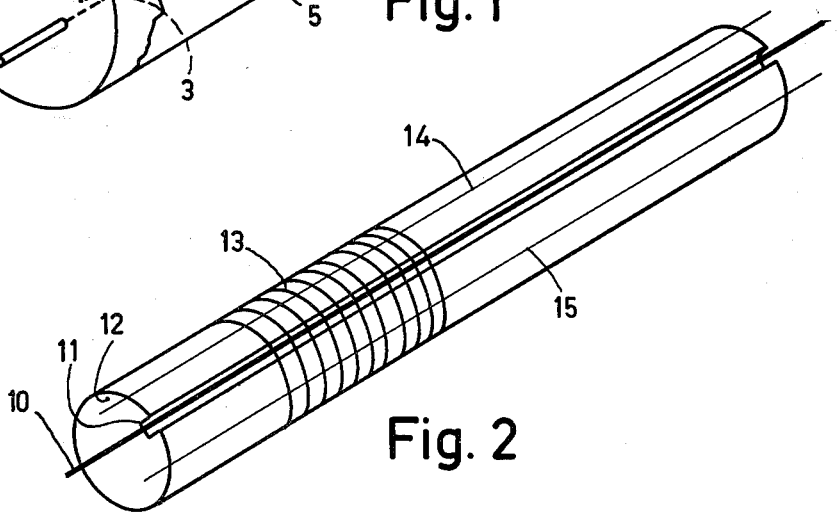

FIG. 1 shows a low pressure mercury vapour discharge lamp having a thin body of solid matter in the cylindrical discharge vessel, and FIG. 2 shows a support wire with associated winding jig for performing a method of producing the thin body.

The lamp shown in FIG. 1 has a tubular glass discharge vessel 1 which is provided at the inside with a luminescent coating 2, consisting for example of calcium halophosphate activated by manganese and antimony. In the discharge vessel there is mercury vapour with a pressure of approximately $6 \times 10^{-3}$ Torr and a rare gas or rare gas mixture with a pressure of some Torr. Disposed in the discharge vessel between the electrodes 3 and 4, respectively, there is a longitudinal body consisting of a support 5 of wire of a chromium-nickel-iron alloy; the wire is coated with a layer of glass enamel by means of which the glass fibres 6, which are approximately 20 μm thick have been fused to the wire. The support extends along the longitudinal axis of the discharge vessel. Each fibre, whose length is substantially equal to the diameter of the discharge vessel is centrally fastened to the support. The space between two successive fibres is approximately 80 μm. Two successive fibres (for example 7 and 8 or 8 and 9) are at a substantial constant angle of approximately 7° to one another. The structure shown in FIG. 1 is produced by means of a method which is described in greater detail in FIG. 2.

A lamp in which the above-described body is disposed is, at a tube diameter of 2.5 cm, an electrode spacing of 20 cm and a length of the body of almost 20 cm., if a rare gas filling (neon) with a pressure of 4 torr is used, suitable for operation in series with a self-induction stabilization element (ballast) of small dimensions from a 220 V mains voltage. With a lamp power of 20 W the luminous flux then amounts to 1000 lumens and the efficiency of lamp and stabilization element is approximately 40 lm/W. For a similar operation from a 120 V mains voltage the operating voltage of the lamp must be decreased. This can be realized by using a rare gas filling of a mixture of 50 percent by volume of argon and 50% by volume of neon at a pressure of 2.5 torr. With the same dimensions of lamp, body and stabilization element, at a lamp power of 20 W the total luminous flux is then 1200 lm and the efficiency of lamp and stabilization element approximately 45 lm/W.

In FIG. 2 a rolled metal wire of an alloy with a suitable coefficient of expansion, 0.1 mm thick and 0.3 mm wide, is indicated by 10. The wire is coated with a layer of glass enamel, approximately 20 μm thick. The wire is disposed in a longitudinal groove 11 in a cylindrical winding jig 12, the winding jig is wound evenly with glass fibre wire 13 having a thickness of approximately 20 μm. The winding pitch is 100 μm. During winding a current of 1 Amp. is passed through the metal wire which causes the glass enamel to soften and to effect fusion with the glass fibre wire 13. Thereafter the wound glass fibre wire is cut along two lines 14 and 15 approximately equidistant from the metal wire over the surface of the jig parallel with the metal wire 10. Thereafter the wire 10 is removed from the longitudinal groove 11 and twisted. The twisting pitch is approximately 5mm. Because the glass enamel must be soft during twisting a current of approximately 0.9 A is passed through the wire during this operation. After twisting and hardening of the glass enamel the brush-like body then obtained is pushed into the discharge vessel.

We claim:

1. A method of manufacturing a low-pressure gas discharge lamp which comprises: providing a discharge vessel, providing a shaped wire support, providing a plurality of fibres, forming a body having a thinly distributed structure by connecting said support to a plurality of said fibres in substantially perpendicularly relationship to said support, twisting said support so that said fibres extend in spatially distributed direction and introducing said body into said discharge vessel.

2. A method as claimed in claim 1 wherein said forming step includes providing a cylindrical jig, positioning said shaped wire support in said jig, providing a glass enamel coating on said support, winding glass or quartz fibre wire helically around said jig, heating said support until said glass enamel is softened so that fusion of said support to said fibre wire is effected, cutting said fibre wire over the surface of said jig parallel to said support at least at one side of said support to form a plurality of individual fibres connected to said support, removing the body comprising said support and said fibres from said jig and twisting said support about the axis thereof while heating said body.

3. A method as claimed in claim 1 wherein said forming step includes fastening said fibers at mutually substantially the same distance therebetween on said support with successive fibres being at an angle of substantially constant value to one another.

4. A method as described in claim 1 wherein said forming step includes providing fibres that are quartz or glass.

5. A method as described in claim 1 wherein said forming step includes connecting a support which has already been coated with an electrically insulating coating.

6. A method as described in claim 1 wherein said forming step includes connecting a support which already has a coating of an adhesive disposed thereon.

7. A method as described in claim 1 wherein said fibres are dimensioned to extend to the wall of said discharge vessel.

8. The method as described in claim 1 wherein said introducing step includes disposing said support at or near the axis of said discharge vessel.

* * * * *